US007319827B2

(12) United States Patent
Yoshizawa

(10) Patent No.: US 7,319,827 B2
(45) Date of Patent: Jan. 15, 2008

(54) APPARATUS AND DEVICE UNIT FOR USE IN THE APPARATUS

(75) Inventor: Hiroshi Yoshizawa, Kanagawa-ken (JP)

(73) Assignee: Ricoh Company Ltd., Tokyo (JP)

( * ) Notice: Subject to any disclaimer, the term of this patent is extended or adjusted under 35 U.S.C. 154(b) by 49 days.

(21) Appl. No.: 11/311,144

(22) Filed: Dec. 20, 2005

(65) Prior Publication Data

US 2006/0169067 A1 Aug. 3, 2006

(30) Foreign Application Priority Data

Dec. 20, 2004 (JP) ..... 2004-367515

(51) Int. Cl.
*G03G 15/00* (2006.01)

(52) U.S. Cl. ..... 399/12; 74/1 R

(58) Field of Classification Search ..... 74/1, 74/1 R; 399/12

See application file for complete search history.

(56) References Cited

U.S. PATENT DOCUMENTS 6,032,002 A * 2/2000 Yokomori et al. ..... 399/12

6,168,267 B1 * 1/2001 Komplin ..... 347/86

FOREIGN PATENT DOCUMENTS

| | | |
|---|---|---|
| JP | 11-072984 | 3/1999 |
| JP | 2000-181176 | 6/2000 |
| JP | 2001-083862 | 3/2001 |
| JP | 2003-195728 | 7/2003 |

* cited by examiner

*Primary Examiner*—David M. Gray
*Assistant Examiner*—Bryan Ready
(74) *Attorney, Agent, or Firm*—Harness, Dickey & Pierce, P.L.C.

(57) ABSTRACT

An apparatus includes a plurality of installation parts, to each of which a device unit is detachably installed to be used, and a restriction device configured to restrict the device unit having been installed in an unused state to and uninstalled from any one of the plurality of installation parts from being installed to any other installation part of the plurality of installation parts.

15 Claims, 7 Drawing Sheets

APPARATUS AND DEVICE UNIT FOR USE IN THE APPARATUS

CROSS-REFERECE TO RELATED APPLICATIONS

The present application claims priority and contains subject matter related to Japanese Patent Application No. 2004-367515 filed in the Japanese Patent Office on Dec. 20, 2004 and the entire contents of which are hereby incorporated herein by reference.

BACKGROUND OF THE INVENTION

1. Field of the Invention

The present invention relates to an apparatus having a plurality of installation parts and a device unit for installation to each installation part of the apparatus.

2. Discussion of the Background

Generally, when dealers handle or users use various apparatuses, consumable items and replacement parts thereof are kept in stock. For example, when handling or using image forming apparatuses of various kinds, the dealers or the users generally have spare devices of a development device, etc., in stock. The dealers and the users therefore must keep a storage space or facility for such spare devices.

In particular, in an image forming apparatus such as a color laser printer having a tandem-type configuration, an image forming device, e.g., a development device, etc., is provided for forming each of black, cyan, yellow, and magenta toner images, that is, four development devices are provided. Therefore, when a user uses the image forming apparatus, spare development devices, etc., for respective colors are kept in stock, so that the number and the kinds of spare devices in stock is inevitably increased. As a result, a larger storage space or facility is necessary, and management of storage items is relatively complicated.

To cope with the above-described problem, an image forming apparatus has been proposed, in which development device units having a common configuration are used for forming toner images of respective colors. A plurality of installation parts, to which the development device units for forming toner images of respective colors are installed, are provided in the image forming apparatus, and each installation part is configured such that the development device unit can be detachably attached. Once such common development device units have been installed to respective installation parts of the image forming apparatus and when the image forming apparatus is operated, developers of corresponding colors, such as toner and ink, are supplied to respective development device units from the main body of the image forming apparatus.

In the above-described image forming apparatus, because the common development device units are used in the plurality of installation parts for forming toner images of respective colors, even when a development device unit uninstalled from one of the installation parts is installed to another one of the installation parts, the development device unit is properly operated. In this case, if the development device unit once installed to and used at an installation part to which toner of a certain color is supplied is installed to another installation part to which toner of a different color is supplied, because the toner of a certain color previously used in the development device unit remains therein, mixing of the toners of different colors is caused in the development device, so that color mixture is caused albeit slightly in a resulting image.

To cope with the above-described color mixture problem, an image forming apparatus has been proposed, in which when a device unit once installed to one of the installation parts of an image forming apparatus is installed to another installation part of the image forming apparatus, a predetermined operation of the image forming apparatus is restricted or a warning is generated.

For example, Japanese Patent Laid-open publication No. 2001-83862 describes an image forming apparatus in which a plurality of process cartridges, each having at least a development device, are installed to respective installation parts, and toners of different colors are supplied to respective process cartridges from a plurality of toner replenishing devices. Regardless of the colors of toners supplied to respective process cartridges installed to the installation parts, a common unit is used for each of the process cartridges, and each process cartridge is configured to freely attachable to and detachable from any installation part. A storage device is provided to each process cartridge, and the information as to the color of toner first supplied to the process cartridge is stored in the storage device. When a process cartridge in which the information as to the color of the toner first supplied thereto has been stored in the storage device is installed to an installation part to which toner of a different color is supplied, the image forming apparatus does not operate or a warning is generated to inform that the process cartridge has been installed to an incorrect installation part. Thus, in the image forming apparatus, even when a user has erroneously installed a process cartridge once installed to and used at an installation part for a certain color to another installation part for another color, the image forming apparatus is not operated or a warning is given to the user, so that the inconvenience, which might have been caused due to such erroneous installation of the process cartridge, can be voided.

In the above-described image forming apparatus, however, because the information as to the color of toner first supplied to each process cartridge is electrically written in the storage device of the process cartridge, unless installation of the process cartridge has been completed, it is not known that the process cartridge has been installed to a wrong installation part, which is inconvenient.

The above-described JP also describes a mechanical device for storing the information as to the color of toner first supplied to each process cartridge. A plurality of protrusion parts is provided to the process cartridge, and when the process cartridge has been first installed to an installation part of the main body, a protrusion part corresponding to the installation part is bent from the side of the main body. The bent protrusion part of the process cartridge is detected using a detector such as an optical sensor, and a controller at the side of the main body determines the installation part to which the process cartridge has been first installed, that is, the color of toner first supplied to the process cartridge, based on the detection result. In this case, however, if a protrusion part of a process cartridge is bent or damaged for some reason other than installing the process cartridge to an installation part and when the process cartridge has been installed to an installation part, if the operation of the image forming apparatus is restricted or a warning is generated, the reason of restriction or warning is unknown to the user, which is troublesome. Further, the bent or damaged protrusion part of the process cartridge cannot be restored to the original state, so that it is hard to reuse the protrusion part as the mechanical device for storing the information as to the color of toner first supplied to the process cartridge.

Furthermore, even if the plurality of protrusion parts is kept together and is arranged in one location, it is relatively difficult to recognize the information as to the color of toner first supplied to the process cartridge based on the outer appearance of the plurality of protrusion parts at first glance, so that the possibility that the process cartridge is installed to a wrong installation part cannot be avoided. That is, even when the user could recognize that the process cartridge has been installed to a wrong installation part, it is relatively hard to recognize the correct installation part for the process cartridge from the outer appearance of the process cartridge, which is inconvenient.

SUMMARY OF THE INVENTION

The present invention has been made in view of the above-discussed and other problems and addresses the above-discussed and other problems.

Preferred embodiments of the present invention provide a novel apparatus having a plurality of installation parts, that prevents a device unit having been initially installed to and uninstalled from one of the plurality of installation parts from being installed to another installation part, and a novel device unit for use in the apparatus.

According to an embodiment of the present invention, an apparatus includes a plurality of installation parts, to each of which a device unit is detachably installed to be used, and a restriction device configured to restrict the device unit having been installed in an unused state to and uninstalled from any one of the plurality of installation parts from being installed to any other installation part of the plurality of installation parts.

In the apparatus, the restriction device may include a recognition device configured to form, when the device unit has been initially installed to an installation part of the plurality of installation parts, a protrusion shape peculiar to the installation part in the device unit, and a prevention device configured to prevent the-device unit from being installed to another installation part of the plurality of installation parts by contacting the protrusion shape formed in the device unit when the device unit is going to be installed to the another installation part. The apparatus may further include an activation device configured to activate the recognition device to form the protrusion shape in the device unit when the device unit is initially installed. The activation device may be provided to a rear side plate of the apparatus. Alternatively, the activation device may be provided to a plate of the apparatus that is closed after installing the device unit.

In the apparatus described immediately above, the recognition device may include a plurality of recognition plates corresponding to the plurality of installation parts and respectively configured to be protruded from different places of the device unit in a direction perpendicular to a direction of installing the device unit. When the device unit has been initially installed to the installation part, a corresponding recognition plate of the plurality of recognition plates is selectively protruded from a corresponding place of the different places of the device unit and thereby the protrusion shape peculiar to the installation part is formed in the device unit. Each recognition plate of the recognition device may include an indication device indicating a corresponding installation part.

Each of the above-described apparatuses may be an image forming apparatus. In this case, the device unit may be a development device of the image forming apparatus, and the development device may be a cartridge unit integrally including at least one or more of an image bearing member, a charging device, a transfer device, and a cleaning device. Alternatively, the device unit may be an ink printing head unit of the image forming apparatus.

According to another embodiment of the present invention, a device unit for use in an apparatus having a plurality of installation parts is provided. The device unit is detachably installed to each of the plurality of installation parts of the apparatus to be used. The device unit includes a housing, and a recognition device including a plurality of recognition plates corresponding to the plurality of installation parts of the apparatus and respectively configured to be protruded from different places of the housing in a direction perpendicular to a direction of installing the device unit. When the device unit has been initially installed to an installation part of the plurality of installation parts of the apparatus, a corresponding recognition plate of the plurality of recognition plates is selectively protruded from a corresponding place of the different places of the housing and thereby a protrusion shape peculiar to the installation part is formed in the device unit.

In the device unit, each recognition plate of the recognition device may include an indication device indicating a corresponding installation part.

In the device unit, the apparatus may be an image forming apparatus. In this case, the device unit may be a development device of the image forming apparatus. Further, the development device may be a cartridge unit integrally including at least one or more of an image bearing member, a charging device, a transfer device, and a cleaning device. Alternatively, the device unit may be an ink printing head unit.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
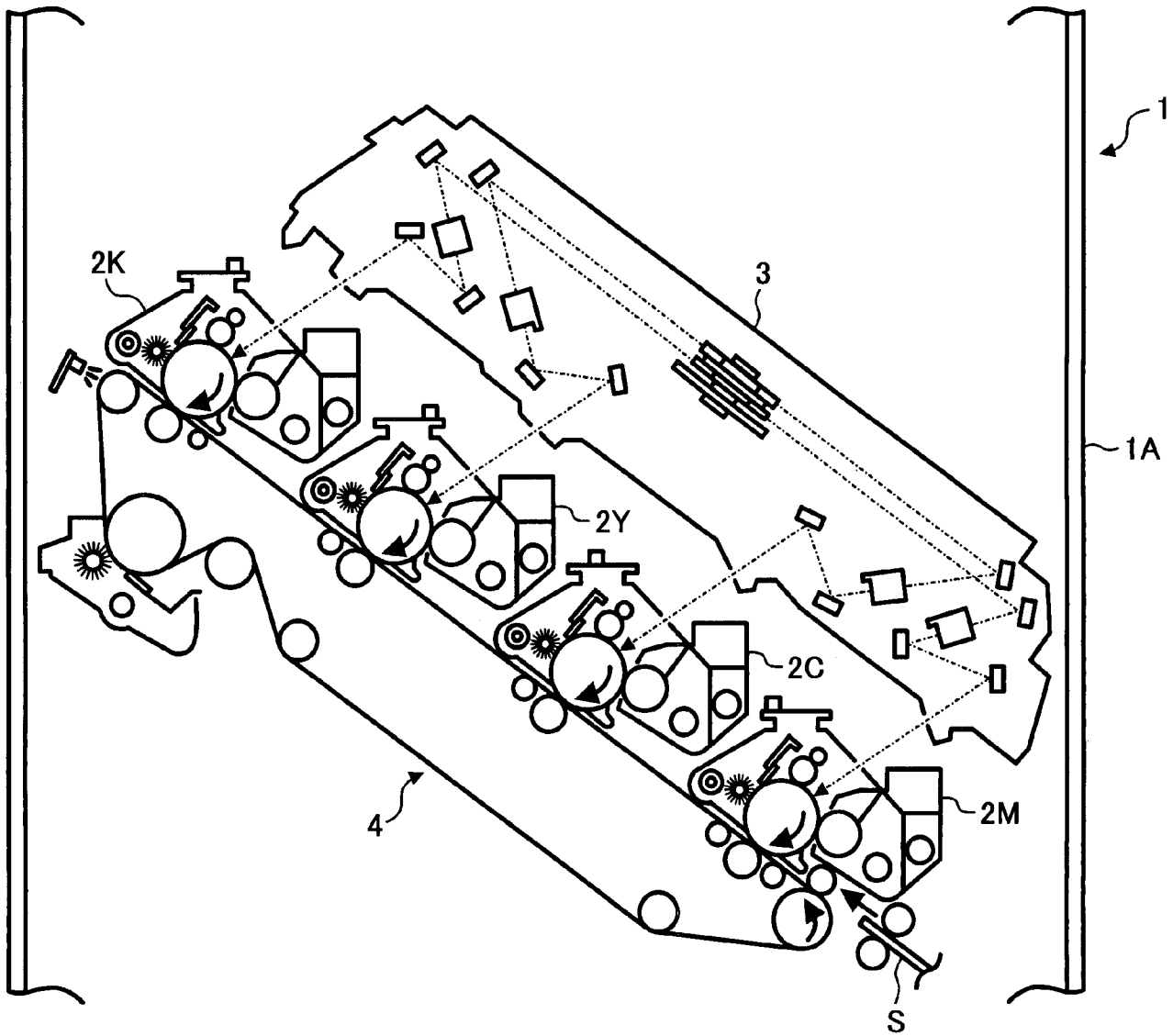
FIG. 1 is a diagram schematically illustrating a configuration of an image forming apparatus as an example of an apparatus having a plurality of installation parts according to the first embodiment of the present invention.

Referring now to the drawings, wherein like reference numerals designate identical or corresponding parts throughout the several views, preferred embodiments of the present invention are described.

FIG. 1 is a front view schematically illustrating a configuration of an image forming apparatus as an example of an apparatus having a plurality of installation parts according to the first embodiment of the present invention.

An image forming apparatus 1 employs a tandem-type image forming method using four photoconductor drums for forming toner images of magenta, cyan, yellow, and black, and includes, as illustrated in FIG. 1, photoconductor units 2K, 2Y, 2C, and 2M, each including a photoconductor drum. Each of photoconductor units 2K, 2Y, 2C, and 2M serves as a device unit according to the first embodiment of the present invention, and is configured to be detachably installable to any one of four installation parts provided in a main body 1A for installing the photoconductor units 2K, 2Y, 2C, and 2M for forming toner images of respective colors.

A sheet conveyance path is formed substantially at the center of the image forming apparatus 1 to extend straight from the lower right side to the upper left side in figure, and during the process that a sheet S is conveyed through the sheet conveyance path in the sheet conveying direction indicated by an arrow, toner images of respective colors formed by corresponding photoconductor units 2M, 2C, 2Y, and 2K are sequentially transferred onto the sheet S. More specifically, the photoconductor unit 2M, the photoconductor unit 2C, the photoconductor unit 2Y, and the photoconductor unit 2K (hereinafter collectively called the photoconductors 2) are arranged in the installation parts arranged on a slanted straight line extending from the right lower side to the upper left side in figure, and a writing unit 3 is arranged above these photoconductor units 2 to perform exposure to the photoconductor units 2 to form respective toner images. Further, a transfer unit 4 is arranged below the photoconductor units 2 to transfer the toner images of respective colors formed by the photoconductor units 2 onto the sheet S.

The transfer unit 4 includes a conveyance belt extending from the lower right side to the upper left side in figure, and while the sheet S is conveyed from the lower right side to the upper left, the toner images of respective colors formed by the photoconductor units 2 are transferred onto the sheet S while being superimposed on top of each other. The transfer unit 4 can be drawn to this side (perpendicular to the sheet surface) to be detached from the installation part by getting down a release lever (not shown) in the release direction from the lock position. Accordingly, when replacing the transfer unit 4 with a new one, the transfer unit 4 is detached from the installation part by releasing the release lever and a new transfer unit 4 is attached to the installation part and is locked.

Each photoconductor unit 2 is configured as a unit in which at least an image bearing member and a development device are integrated with each other in a housing, and is easily attachable to and detachable from each installation part. The configuration of each photoconductor unit 2 is common to each other without depending on the installation part. That is, each photoconductor unit 2 is formed substantially in the same shape to be hardly distinguishable from each other in the outer appearance, and is installable to any one of the installation parts at least in an unused state, that is, before the photoconductor unit 2 is installed to an installation part for the first time and toner is supplied to the photoconductor unit 2 at the installation part. That is, all of the photoconductor units 2 are so-called universal cartridge units having substantially the same configurations and functions, and are controlled by a controller at the side of the main body 1A to adjust the functions according the characteristics of toners supplied to respective photoconductor units 2.

Further, a stopper (not shown) is provided to each installation part to engage with the photoconductor unit 2 installed to the installation part to lock the photoconductor unit 2 in a predetermined place of the installation part. The photoconductor unit 2 can be uninstalled from the installation part, for example, for replacement, by releasing the stopper. The photoconductor unit 2 is installed by being moved from this side to the depth side in the direction perpendicular to the sheet surface in figure and is uninstalled by being moved in the reverse direction.

Figure 2:
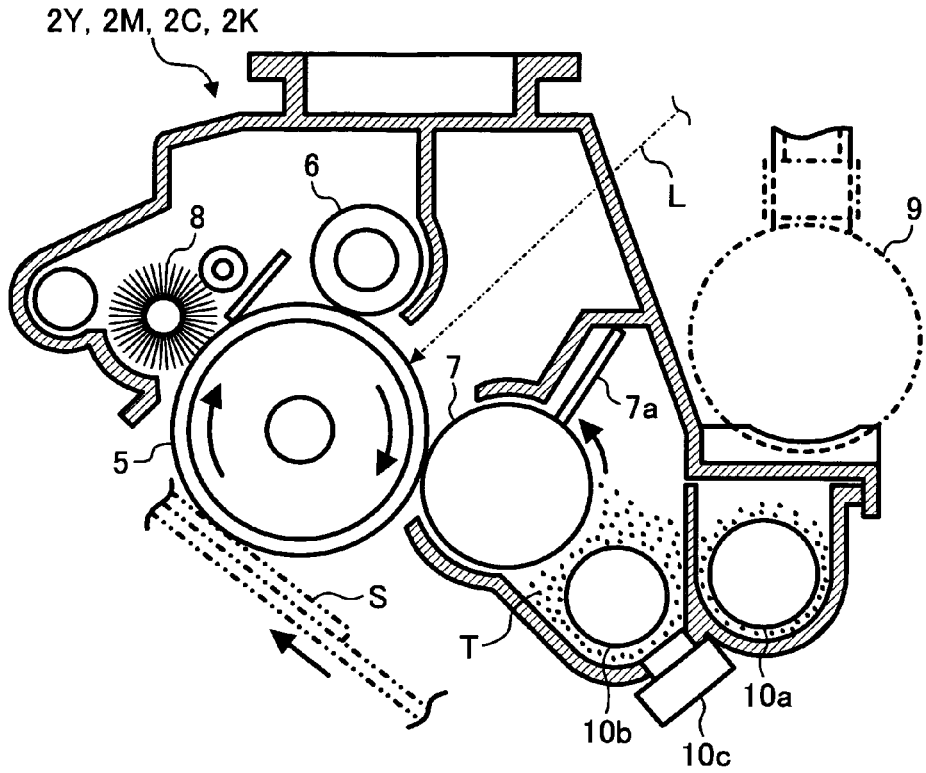
FIG. 2 is a diagram schematically illustrating a configuration of a photoconductor unit as an example of a device unit for installation to each installation part of the image forming apparatus.

FIG. 2 is a diagram schematically illustrating the configuration of the photoconductor unit 2 in the state that the photoconductor unit 2 has been installed. The photoconductor unit 2 is configured as a unit in which a photoconductor drum 5 as an image bearing member, a charge roller 6 as a charge device to charge the surface of the photoconductor drum 5, a development roller 7 as a development device to visualize with toner a latent image formed on the surface of the photoconductor drum 5 by an exposure light L, and a cleaning brush 8 as a cleaning device to remove residual toner on the surface of the photoconductor drum 5 after transferring a toner image to the sheet S are integrated with each other. The charge roller 6, the development roller 7, and the cleaning brush 8 are sequentially arranged around the photoconductor drum 5 from the upstream side to the downstream side in the direction the photoconductor drum 5 rotates, and the photoconductor drum 5 is positioned to face the sheet S being conveyed through the sheet conveyance path.

Reference numeral 9 denotes a toner cartridge provided at the side of the main body 1A. The toner cartridge 9 contains a predetermined quantity of toner of a color corresponding to the installation part (magenta, cyan, yellow or black), and is configured to supply the toner to the photoconductor unit 2 installed to the installation part as necessary as the photoconductor unit 2 consumes the toner by forming toner images.

The toner is conveyed from the toner cartridge 9 to the development device (roller) 7 of the photoconductor unit 2 by an air pump (not shown). Further, an optical sensor (not shown) is provided to a toner conveyance nozzle (not shown) related to conveyance of the toner to detect if the toner in the toner cartridge 9 is close to being running out by detecting a toner conveying state through the toner conveyance nozzle.

Toner T conveyed from the toner cartridge 9 to the photoconductor unit 2 is conveyed, while being stirred together with developer by rotation movement of a right side convey screw 10*a* and a left side convey screw 10*b*, to the developer roller 7 as the developer having a predetermined toner density. The developer adhering on the development roller 7 is restricted by a development doctor blade 7*a* in quantity and is conveyed onto the outer circumferential surface of the photoconductor drum 5 to visualize the latent image formed on the surface of the photoconductor drum 5 by exposure with the writing unit 3 into a toner image. A toner density sensor 10*c* is arranged in the vicinity of a bottom part of a part receiving the supplied toner to detect the toner density of the developer to perform controlling of the toner density. The charge roller 6 rotates in the direction reverse to the direction the photoconductor drum 5 rotates, and uniformly charges the surface of the photoconductor drum 5. A charge cleaning roller (not shown) is arranged above the charge roller 6 to always contact the charge roller 6 to remove residual charge on the charge roller 6.

Figure 3:
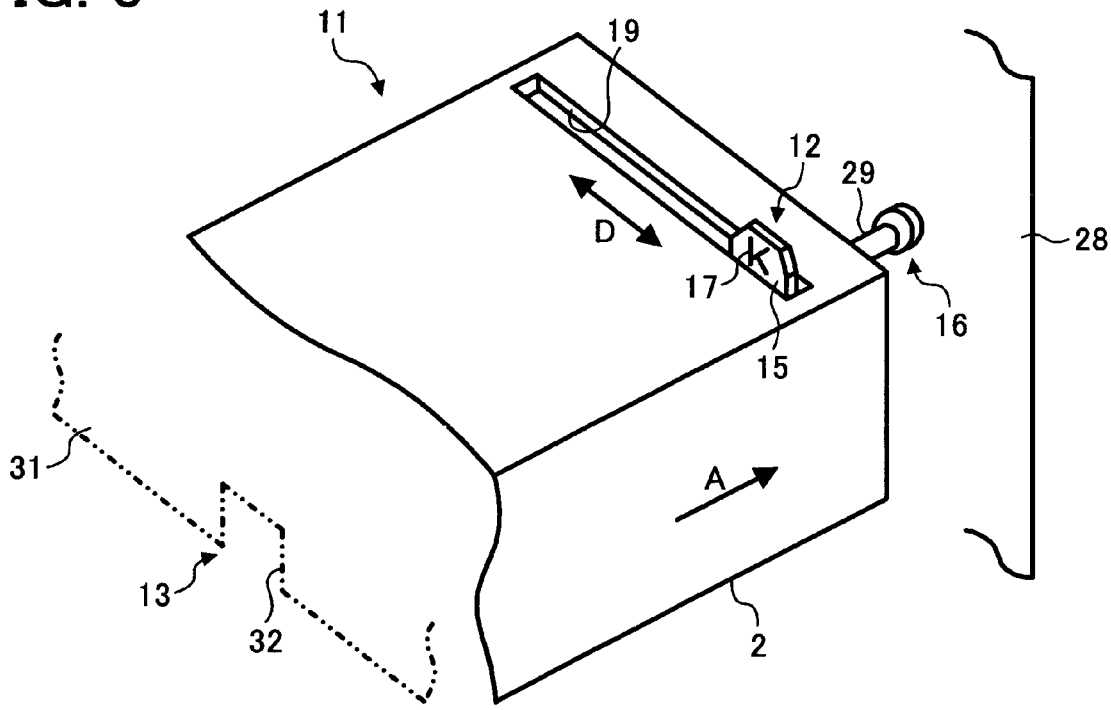
FIG. 3 is a diagram illustrating a restriction device provided to the main body of the image forming apparatus and the photoconductor unit to physically prevent the photoconductor unit that has been installed to and used at an installation part before from being installed to another installation part.

FIG. 3 is a diagram illustrating a restriction device 11 provided to the main body 1A and the photoconductor unit 2 to physically prevent the photoconductor unit 2 that has been installed in an unused state to and uninstalled from any one of the plurality of installation parts from being installed to any other installation part of the plurality of installation parts. The restriction device 11 includes a plurality of recognition devices 12 (four recognition devices 12, in this example) provided to the photoconductor unit 2 to correspond to the plurality of installation parts of the main body 1A, and a prevention device 13 provided to the main body 1A.

The recognition devices 12 include recognition plates 15 configured to be protruded from the photoconductor unit 2, respectively, and are arranged such that respective recognition plates 15 are protruded from different protrusion places of the housing of the photoconductor unit 2 in the direction perpendicular to the installing direction of the photoconductor unit 2. An activation device 16 is provided to each installation part of the main body 1A to select and activate a recognition device 12 corresponding to the installation part from among the plurality of recognition devices 12 provided to the photoconductor unit 2. When an unused photoconductor unit 2 is installed to an installation part of the plurality of installation parts for the first time, the recognition device 12 corresponding to the installation part is activated to cause the recognition plate 15 to protrude from a protrusion place of the housing of the photoconductor unit 2 uniquely corresponding to the installation part, so that a convex shape peculiar to the installation part is formed in the photoconductor unit 2.

That is, the activation device 16 is provided in a predetermined place of each installation part, and the recognition device 12 corresponding to the installation part is selected and activated by the activation device 16, so that the recognition plate 15 of the recognition device 12 is protruded from one of different places of the housing of the photoconductor unit 2 in the direction perpendicular to the installing direction of the photoconductor unit 2 and thereby the convex shape peculiar to the installation part is formed in the photoconductor unit 5. The recognition device 12 keeps the recognition plate 15 that has been protruded in the protruded state so that the convex shape formed in the photoconductor unit 2 is kept as the one formed when the photoconductor unit 2 has been installed to the main body 1A for the first time.

Further, an indication device 17 indicating each corresponding installation part is provided to a protrusion part of the recognition plate 15 that protrudes from the photoconductor unit 2 to be exposed, so that the installation part to which the photoconductor unit 2 has been installed for the first time can be visually recognized.

As the indication device 17, for example, an indication unique to each installation part, such as a character, a design, etc., is provided by means of printing, punching, engraving, etc. The indication is provided at the tip end part of each recognition plate 15, which is protruded from the photoconductor unit 2 to be exposed. For example, as the indication, the letter "K", which is an abbreviation for "black", may be formed to express that the color of toner supplied at the installation part to which the photoconductor unit 2 has been installed is black. The method of indicating the color of toner is not limited to indicating the color of toner using a letter as described above. For example, the indication may be realized by directly printing the color of toner on the tip end part of each recognition plate 15. The indication may be realized by the combination of indicating the color of toner using the letter expressing the color of toner and indicating the color of toner by printing the color of toner. For example, after engraving a letter expressing the color of toner at the tip end part of the recognition plate 15, the whole part of the tip end part of the recognition plate 15 may be painted with the color of toner, or the letter expressing the color of toner may be drawn in the color of toner. Further, a separate member may be provided to each recognition plate 15 to serve as the indication device 17. For example, a label may be provided to the recognition plate 15, for example by sticking, as the indication device 17.

The prevention device 13 is configured to allow passage of the recognition plate 15 protruded from the photoconductor unit 2 when the photoconductor unit 2 is going to be installed to the same installation part as the one to which the photoconductor unit 2 has been initially installed and to physically prevent passage of the recognition plate 15 protruded from the photoconductor unit 2 and to thereby prevent installment of the photoconductor unit 2 when the photoconductor unit 2 is going to be installed to another installation part different from the one to which the photoconductor unit 2 has been initially installed.

A long hole 19 is formed in the housing of the photoconductor unit 2 in the vicinity of a side edge of the tip end side of the photoconductor unit 2 in the installing direction of the photoconductor unit 2 in a predetermined length in the widthwise direction of the photoconductor unit 2 perpendicular to the installing direction of the photoconductor unit 2. The four recognition devices 12 are arranged inside of the photoconductor unit 2 in parallel with each other in the widthwise direction of the photoconductor unit 2 such that respective recognition plates 15 protrude from different places in the longitudinal direction of the long hole 19 indicated by an arrow D, which are peculiar to corresponding installation parts. These recognition devices 12 have substantially the same configuration and are configured to protrude respective recognition plates 15 independently from each other. A recognition device 12 corresponding to the installation part for black, a recognition device 12 corresponding to the installation part for yellow, a recognition device 12 corresponding to the installation part for cyan, and a recognition device 12 corresponding to the installation part for magenta are sequentially arranged from the right side to the left side in the installing direction of the photoconductor unit 2. Toners of respective colors are supplied to the photoconductor units 2 installed to respective installation parts. Accordingly, by indicating the color of the toner supplied to the installed photoconductor unit 2 by the indication device 17 of the protruded recognition plate 15, the installation part to which the photoconductor unit 2 has been initially installed can be visually identified. In FIG. 3, although only a part of the upper surface of the photoconductor unit 2 is illustrated, in the state that none of the recognition plates 15 are protruded, the upper surface of the photoconductor unit 2 is formed flat without having any protrusion which may hinder installation of the photoconductor unit 2.

Figure 4A:
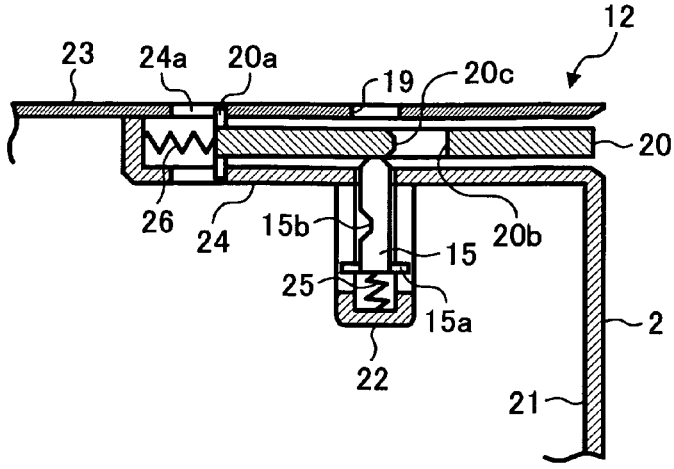
FIG. 4A is a cross section of a recognition device of the photoconductor unit before the photoconductor unit has been installed to an installation part for the first time.
Figure 4B:
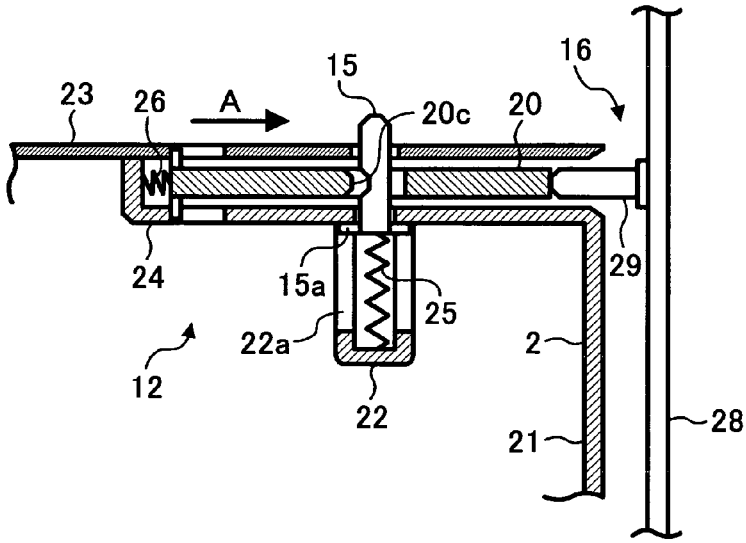
FIG. 4B is a cross section of the recognition device in the state that the photoconductor unit has been installed for the first time.
Figure 4C:
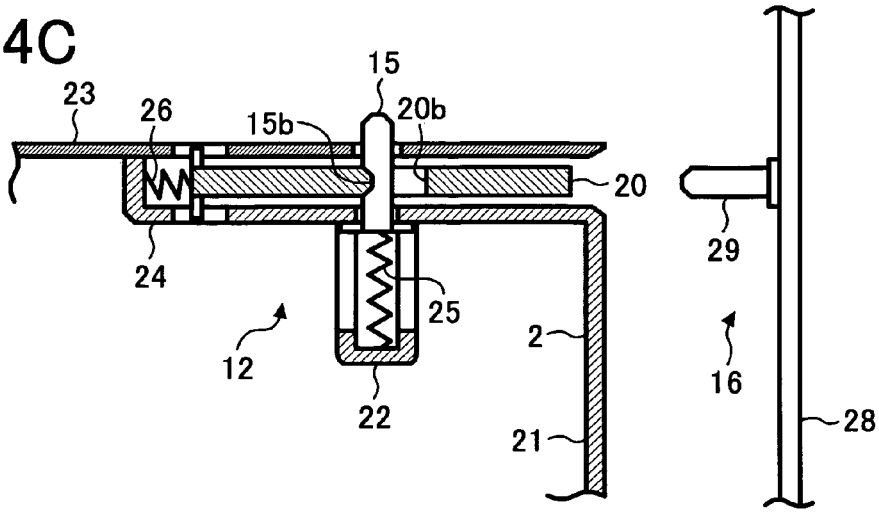
FIG. 4C is a cross section of the recognition device in the state that the photoconductor unit is being uninstalled after having been installed for the first time.

FIG. 4A is a cross section of each recognition device 12 of the photoconductor unit 2 before the photoconductor unit 2 is installed to an installation part of the main body 1A for the first time. FIG. 4B is a cross section of the recognition device 12 in the state that the photoconductor unit 2 has been installed for the first time. FIG. 4C is a cross section of the recognition device 12 in the state that the photoconductor unit 2 is being uninstalled after having been installed for the first time.

Each recognition device 12 includes, as illustrated in FIG. 4A, the recognition plate 15 pressed to protrude outside the photoconductor unit 2 a predetermined distance, and a stopper 20 configured to restrict protrusion of the recognition plate 15 in the initial state and to lock the recognition plate 15, when the recognition plate 15 has been protruded to a predetermined position, in the protruded position.

The recognition plate 15 is formed substantially in a long plate, and in the initial state of the photoconductor unit 2 illustrated in FIG. 4A, the recognition plate 15 is accommodated in a vertical accommodation part 22 provided to a lower cartridge frame 21 of the photoconductor unit 2 to extend vertically. An upper opening of the vertical accommodation part 22 is communicated at least with the long hole 19 formed in an upper cartridge frame 23 serving as the upper surface of the housing of the photoconductor unit 2. Accordingly, the recognition plate 15 is directed in the vertical direction perpendicular to the installing direction of the photoconductor unit 2 and moves in the vertical direction to protrude outside the photoconductor unit 2 from the upper surface thereof. The recognition plate 15 is made of a predetermined material in a predetermined thickness so as to have sufficient strength for stopping the photoconductor unit 2 being moved in the installing direction when the recognition plate 15 in the protruded state contacts a fixed member of the main body 1A.

The stopper 20 is formed in a long plate wider than the recognition plate 15 in width, and is accommodated in a lateral accommodation part 24 formed by the upper cartridge frame 23 and the lower cartridge frame 21 to extend in the lateral direction in figure, i.e., in the installing direction of the photoconductor unit 2, so as to be positioned immediately above the upper end of the recognition plate 15 located in the lower part of the vertical accommodation part 22 and to be directed in the installing direction of the photoconductor unit 2. One end of the lateral accommodation part 24 is opened at a part of a vertical side wall of the lower cartridge frame 21 located at the tip end side of the photoconductor unit 2 in the installing direction of the photoconductor unit 2, and the other end is closed. The total length of the stopper 20 is set such that the tip end of the stopper 20 does not protrude the opening of the lateral accommodation part 24 but reaches the vicinity of the opening.

The recognition plate 15 is pressed upward in figure by a spring 25. That is, the spring 25 is arranged at the lower end (the base end) of the recognition plate 15 in the compressed state to depress the base end of the recognition plate 15 by the restoration force of the spring 25, and thereby the recognition plate 15 is pressed to move upward. Further, a lateral protrusion 15*a* is formed at the base end of the recognition plate 15, and the protrusion 15*a* is located in a cut part 22*a* formed in the vertical accommodation part 22 by cutting a predetermined area of the side wall forming the vertical accommodation part 22. The movement area of the recognition plate 15 is defined by the cut part 22*a*. When the restriction relative to the recognition plate 15 by the stopper 20 is released as described below, the recognition plate 15 is moved upward in the protruding direction by being pressed by the spring 25, and the protrusion 15*a* provided to the recognition plate 15 reaches the upper limit of the cut part 22*a*. Thereby, the recognition plate 15 is stopped in the state of being protruded at the maximum, illustrated in FIG. 4B.

A spring 26 in the compressed state is arranged at the left side end (the base end) of the stopper 20 to always press the stopper 20 toward right in figure. Further, a protrusion 20*a* is integrally formed at the base end of the stopper 20, and the protrusion 20*a* is located in a cut part 24*a* formed in the lateral accommodation part 24 by cutting a predetermined area of the side wall of the lateral accommodation part 24. The movement area of the stopper 20 is defined by the cut area 24*a*. That is, the stopper 20 is pressed by the spring 26 toward right in figure such that the protrusion 20*a* of the stopper 20 reaches the end of the cut part 24*a* at the right side in figure. Thereby, the stopper 20 is restricted in the initial state illustrated in FIG. 4A. A through-hole 20*b* is formed substantially at the center of the stopper 20 in the longitudinal direction thereof in a size that the recognition plate 15 passes through. In the initial state illustrated in FIG. 4A, the through-hole 20*b* of the stopper 20 is located in the position separated from the position right above the recognition plate 15, so that the tip end of the recognition plate 15 contacts a part of the stopper 20 other than the through-hole 20*b* thereof. Thereby, the recognition plate 15 is restricted from being moved in the protruding direction and the recognition plate 15 is kept in the lower position within the vertical accommodation part 22.

Further, as a lock device for locking the recognition plate 15 in the maximally protruded position, a concave part 15*b* is formed substantially at the center of the recognition plate 15 so as to be positioned in the lateral accommodation part 24 when the recognition plate 15 has been moved to the maximally protruded position, and a protrusion part 20*c* in a tapered shape is formed in the internal circumferential surface of the through-hole 20*b* so as to engage with the concave part 15*b* of the recognition plate 15 moved to the maximally protruded position.

Furthermore, as described above, the indication device 17 is provided to each recognition plate 15 so that the relation between the corresponding installation part and the color of toner supplied to the photoconductor unit 2 installed to the corresponding installation part can be visually identified.

Each activation device 16 includes a striker 29 provided in a protruding manner to a rear side plate 28 fixedly arranged at the side of the main body 1A. The rear side plate 28 is provided to serve as a vertical wall opposing the tip end surfaces of the photoconductor units 2 installed to respective installation parts. The striker 29 is provided in a predetermined place of a part of the rear side plate 28 corresponding to each installation part to protrude in the direction opposite the installing direction of the photoconductor unit 2. That is, the striker 29 for each installation part is provided in the position opposing the opening of the lateral accommodation part 24 of the recognition device 12 corresponding to the installation part to release the restriction relative to the recognition plate 15 by the stopper 20 of the recognition device 12.

Accordingly, when the photoconductor unit 2 is installed to an installation part for the first time, as the photoconductor unit 2 is moved in the direction of being installed to the installation part, the striker 29 for the installation part is brought into contact with the stopper 20 of the recognition device 12 corresponding to the installation part among the four recognition devices 12 provided to the photoconductor unit 2, and thereby the stopper 20 of the recognition corresponding to the installation part is moved. That is, the striker 29 enters into the lateral accommodation part 24 of the recognition device 12 corresponding to the installation part through the opening thereof, contacts the tip end of the stopper 20 accommodated in the lateral accommodation part 24, and moves the stopper 20 a predetermined distance in the direction of the base end side of the stopper 20 (toward left in figure) while opposing the pressing force of the stopper 20 given by the spring 26. Thereby, restricting the recognition plate 15 in the initial state by the stopper 20 is released, and the recognition plate 15 of the recognition device 12 corresponding to the installation part passes through the through-hole 20*b* of the stopper 20 and protrudes from a predetermined place of the long hole 19 provided in the upper cartridge frame 23 of the photoconductor unit 2.

When the photoconductor unit 2 is uninstalled from the main body 1A, as illustrated in FIG. 4C, the stopper 20 is released from being pressed by the striker 29, and moves toward the opening of the lateral accommodation part 24, i.e., toward right in figure. Thereby, the protrusion 20*c* of the stopper 20 engages with the concave part 15*b* of the recognition plate 15, so that the movement of the recognition plate 15 in the up-and-down direction is restricted. Thus, when the photoconductor unit 2 is moved in the direction opposite the installing direction of the photoconductor unit 2 and thereby the striker 29 is moved out of the lateral accommodation part 24, the stopper 20 pressed toward the opening of the lateral accommodation part 24 is moved until the protrusion 20*c* formed in the through-hole part 20*b* thereof engages with the concave part 15*b* of the recognition plate 15, and thereby the recognition plate 15 is locked in the protruded state.

Thus, when an unused photoconductor unit 2 has been initially installed to an installation part of the main body 1A, a protrusion shape that did not exist in the photoconductor unit 2 is generated in the photoconductor unit 2. That is, when an unused photoconductor unit 2 has been initially installed to an installation part of the main body 1A, the recognition plate 15 of the recognition device 12 corresponding to the installation part is caused to protrude from the place of the photoconductor unit 2 that is peculiar to the installation part and the recognition plate 15 is locked in the protruded state, so that the protrusion shape that did not exists in the photoconductor unit 2 in the initial state is generated in the photoconductor unit 2. Further, the indication device 17 indicating the color of toner supplied to photoconductor unit 2 at the installation part is provided to the protruded part of the recognition plate 15. Thus, in addition to the distinctiveness based on the place the recognition plate 15 protrudes, that is peculiar to the installation part, the distinctiveness based on the unique indication on the indication device 17 is obtained.

Further, in the above-described recognition device 12, the recognition plate 15 in the locked protruded state in FIG. 4C can be returned to the initial state illustrated in FIG. 4A using a thin rod, so that the photoconductor unit 2 can be returned to the initial state for reuse. That is, by inserting a rod into the opening of the lateral accommodation part 24 accommodating the stopper 20 and pressing the tip end of the stopper 20 toward left in figure, the engagement of the protrusion 20*c* of the stopper 20 and the concave part 15*b* of the recognition plate 15 is released, and thereafter, by inserting another rod into a part of the long hole 19 communicating with the vertical accommodation part 22 accommodating the recognition plate 15, thrusting down the recognition plate 15 so that the tip end thereof is located below the moving path of the stopper 20 in the lateral accommodation part 24, and thereafter pulling out both of the rods, the recognition device 12 is returned to the initial state illustrated in FIG. 4A. Thus, the recognition device 12 can be easily returned to the initial state so that the photoconductor unit 2 is returned to the initial state.

Figure 5:
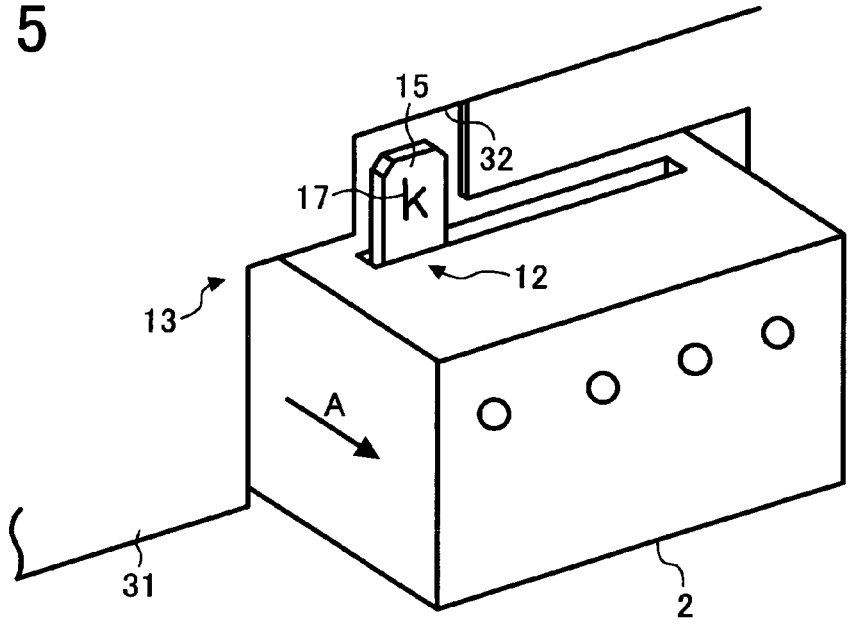
FIG. 5 is an oblique perspective view illustrating a state that the photoconductor unit is in the middle of installment to a correct installing part again.

FIG. 5 illustrates a state that the photoconductor unit 2 once installed to an installation part of the main body 1A and uninstalled for some reason is going to be installed to the same installation part again.

The prevention device 13 is provided for each installation part, and as illustrated in FIG. 5, each prevention device 13 includes a cut part 32 formed in a predetermined place of a front side plate 31 provided at the side of the main body 1A. The front side plate 31 is fixedly arranged at this side of the main body 1A in the installing direction of the photoconductor unit 2. The front side plate 31 extends in the direction perpendicular to the installing direction of the photoconductor unit 2 and is at least longer than the long hole 19 formed in the upper surface of the photoconductor unit 2. The front side plate 31 is configured such that the circumferential edge serving as the upper long side of the installation part at least opposes and is separated a predetermined distance from the upper surface of the photoconductor unit 2 in the middle of being installed. The cut part 32 is formed to open downwardly in the predetermined place of the front side plate 31 in a size that the protruded part of the recognition plate 15 can pass. The position of the cut part 32 is different for each installation part, and the cut part 32 for each installation part is formed to oppose the position to which the recognition plate 15 of the corresponding recognition device 12 of the photoconductor unit 2 is protruded when the photoconductor unit 2 has been installed to the installation part for the first time.

Accordingly, when the photoconductor unit 2 in which the recognition plate 15 of the selected recognition device 12 has been protruded at the time of initial installation to an installation part is installed again to the same installation part, the recognition plate 15 protruded from the photoconductor unit 2 can pass the cut part 32 formed in the front side plate 31 of the main body 1A as illustrated in FIG. 5. That is, when installing the photoconductor unit 2 to the installation part to which the photoconductor unit 2 has been initially installed, because the recognition plate 15 corresponding to the initial installation part has been protruded at the time of initial installation, the protruded recognition plate 15 passe s through the cut part 32 without contacting the front side plate 31, so that the photoconductor unit 2 can be installed to the installation part.

On the other hand, even if it is tried to install the photoconductor unit 2 initially installed to an installation part to another installation part for the second time, because the recognition plate 15 corresponding to the initial installation part has been protruded at the time of initial installation and the position of the cut part 32 provided for the installation part to which the photoconductor unit is going to be installed for the second time does not accord with the position of the protruded recognition plate 15, the recognition plate 15 is brought into contact with the front side plate 31, so that the photoconductor unit 2 is prevented from being further moved in the installing direction of the photoconductor unit 2. Thus, installing the photoconductor unit 2 once installed to an installation part to another incorrect installation part can be stopped in the middle thereof and prevented.

In particular, because the recognition plate 15 protrudes from a place at the side of the tip end of the photoconductor unit 2 in the installing direction and at the same time the front side plate 31 is positioned at this side in the installing direction, the operation of installing the photoconductor unit 2 to the installation part different from the initial installation part is stopped immediately after starting the installing operation.

Further, because the installing operation is stopped when the recognition plate 15 protruded from the photoconductor unit 2 and indicating the correct installation part contacts the front side plate 31, the user's attention can be directed to the protruded recognition plate 15. Thereby, the user is led to check the position of the protruded recognition plate 15 with the position of the cut part 32 formed in the front side plate 31, so that the user can recognize that the installation part is incorrect, and at the same time recognize that the correct installation part is indicated by the indication device 17 provided to the protruded part of the recognition plate 15.

Figure 6:
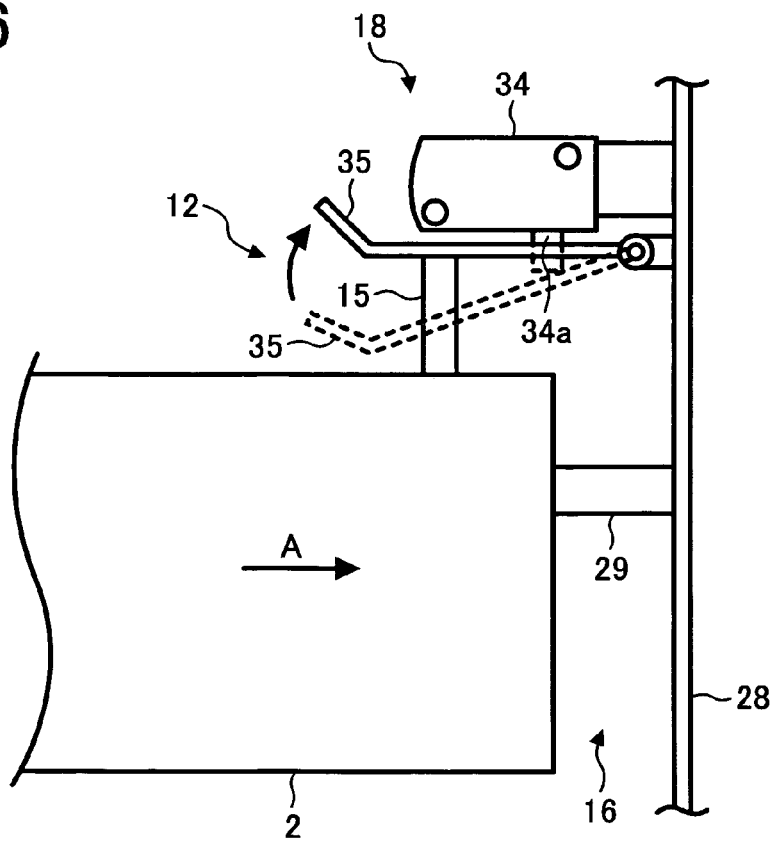
FIG. 6 is a side view illustrating a configuration of a detection device detecting that the photoconductor unit has been correctly installed again.

Further, as illustrated in FIG. 6, a detection device 18 is provided for each installation part to detect that the recognition plate 15 of the recognition device 12 corresponding to the installation part has been protruded. When the photoconductor unit 2 is installed to an installation part for the first time, the detection device 18 detects that the recognition device 12 corresponding to the installation part has correctly operated and thereby the recognition plate 15 thereof has been protruded. Further, when the photoconductor unit 2 has been erroneously installed to an incorrect installation part for some reason, the detection device 18 detects at least that erroneous installation has been performed.

The detection device 18 for each installation part is provided in a predetermined place of the rear side plate 28. The detection device 18 includes a detection switch 34 provided with a switch button 34*a* directed downward, and a lever-type actuator 35 configured to swing upward to depress the switch button 34*a* of the detection switch 34 from a downwardly inclined position indicated by a broken line. The detection switch 34 is positioned above the installation part and at the rear side in the installing direction of the photoconductor unit 2 so as to oppose the position to which the recognition plate 15 of the installed photoconductor unit 2 protrudes. The position of the tip end of the lower end of the switch button 34*a* when the switch button 34*a* is not depressed is set to be lower than the position of the tip end of the recognition plate 15 when the recognition plate 15 has been protruded.

The actuator 35 is a lever member formed in a long plate having a predetermined length. The actuator 35 is supported at the base end thereof by the rear side plate 28 so as to pivot, with the tip end at the free end side thereof directed to the direction opposite the installing direction of the photoconductor unit 2, and is positioned immediately below the switch 34 and above the lower end of the switch button 34*a*, and when the actuator 35 is swung upwardly from the lower position indicated by the broken line, a part of the base end side of the actuator 35 contacts and depresses the switch button 34*a* and thereby the detect switch 34 is turned on. Further, a predetermined part of the tip end side of the actuator 35 is bent upward so that when the photoconductor unit 2 is installed, the tip end of the actuator 35 will not be caught on the protruded recognition plate 15 of the photoconductor unit 2 being moved for installation.

When the photoconductor unit 2 in which the indication plate 15 of the recognition device 12 has been selectively protruded at the time of initial installation to an installation part is installed to the same installation part, the actuator 35 provided in the place of the rear side plate 28 corresponding to the tip of the photoconductor unit 2 is rotated upward by the photoconductor unit 20 being moved in the direction of the arrow A in FIG. 6, and thereby the switch button 34*a* of the detect switch 34 is depressed and a turning-on signal is generated. Thereby, it is confirmed that the photoconductor unit 2 has been correctly installed again. Further, when the photoconductor unit 2 is initially installed to an installation part, the actuator 35 provided for the installation part is pressed by the recognition plate 15 of the photoconductor unit 2, protruding from below, so as to be rotated upward, and thereby the switch button 34*a* of the detection switch 34 is depressed and the turning-on signal is generated. Thereby, it can be confirmed that the recognition device 12 of the photoconductor unit 2 corresponding to the installation part has been correctly activated and the correct recognition plate 15 has been protruded.

The detection switch 34 for each installation part is arranged in the place of the rear side plate 28 corresponding to the position to which the recognition plate 15 of the recognition device 12 corresponding to the installation part is protruded when the photoconductor unit 2 has been installed to the installation part. Accordingly, the switch button 34*a* of each detection switch 34 cannot be depressed by the photoconductor unit 2 in which the recognition plate 15 of the corresponding recognition device 12 is not protruded or the recognition plate 15 itself is not provided, so that when erroneous installation of the photoconductor unit 2 has been performed, it can be immediately known that the erroneous installation has been performed.

An output signal line transmitting the turning-on signal of the detection switch 34 is connected with a controller (not shown) controlling operations of respective parts of the main body 1A, and when the controller has received the turning-on signal indicating that the photoconductor unit 2 has been correctly installed to the main body 1A, the controller continues the regular operations such as the regular image forming operations, and when the turning-on signal is not obtained, the controller stops at least a subsequent image forming operation and at the same time informs that erroneous installation of the photoconductor unit 2 has occurred by way of displaying a warning message on a display device of an operation panel provided to the main body 1A or generating a warning sound with a sound generation device such as a buzzer.

On the other hand, the photoconductor unit 2 that does not have the configuration of the recognition plate 15 as described above (e.g., a photoconductor unit manufactured by a third party other the manufacturer of the photoconductor unit 2) cannot turn on the detection switch 34, so that even when the photoconductor unit 2 has been installed, a subsequent image forming apparatus will not be performed. Therefore, a trouble that may be caused by installment of such a photoconductor unit, e.g., deterioration of resulting image quality, etc., can be avoided.

Thus, according to the first embodiment of the present invention described above, in an apparatus in which a plurality of common photoconductor units are installed to a plurality of installation parts, each of the plurality of common photoconductor units that has been initially installed to an installation part of the plurality of installation parts and thereafter uninstalled can be prevented from being installed to another installation part of the plurality of installation parts, and can be caused to be always installed to the installation part to which the photoconductor unit has been initially installed. Thereby, malfunctioning of the photoconductor unit or deterioration of image quality due to erroneous installation of the photoconductor unit (i.e., the photoconductor unit is installed to an installation part different from the initial installation part) can be prevented.

Further, according to this embodiment, an indication indicating the color of toner supplied to the photoconductor unit at the installation part to which the photoconductor unit has been initially installed is provided to the protruding part of the recognition plate of the recognition device of the photoconductor unit. Therefore, by visually confirming the indication of the protruded recognition plate of the photoconductor unit, the user can not only easily and surely recognize that the photoconductor unit has been installed to an installation part before but can also recognize directly and viscerally to which installation part the photoconductor unit has been initially installed, that is, the color of toner supplied to the photoconductor unit before. Therefore, as compared with a photoconductor unit in which a plurality of protrusions are provided and in which when the photoconductor unit has been installed to an installation part of a plurality of installation parts of an apparatus for the first time, a corresponding protrusion of the photoconductor unit is bent or damaged to indicate the installation part to which the photoconductor unit has been initially installed, the chance can be greatly reduced that the user erroneously installs the photoconductor unit, that has been initially installed to an installation part and thereafter uninstalled, to another installation part.

Furthermore, even when it is tried to install the photoconductor unit to an installation part other than the one to which the photoconductor unit has been initially installed, movement of the photoconductor unit in the installing direction is stopped in the midst of the installing operation by a restriction device. Therefore, not only erroneous installment is prevented but also the user can recognize early that the erroneous installation has been tried, so that the user can install the photoconductor unit to a correct installation part early. That is, the trouble of finding out that the photoconductor unit has been installed to an incorrect installation part after completing the installation and uninstalling the installed photoconductor unit is avoided.

Furthermore, a trouble that may be caused when the photoconductor unit has been installed to an incorrect installation part can be avoided. That is, even when a toner supply mechanism is configured such that toner is not conveyed to the installed photoconductor unit by own weight of the toner but is supplied to the photoconductor unit by means of a mechanical method, the toner adheres to a toner supply opening of the installation part. Therefore, when a photoconductor unit is erroneously installed to the installation part, the toner adhered to the toner supply opening of the installation part falls even slightly to a toner reception opening of the photoconductor unit, so that mixing of toners of different colors, i.e., mixing of colors, cannot be avoided. In this embodiment, because installing a photoconductor unit to an installation part that is different from the installation part to which the photoconductor unit has been installed before is avoided, such mixing of colors is avoided.

Figure 7:
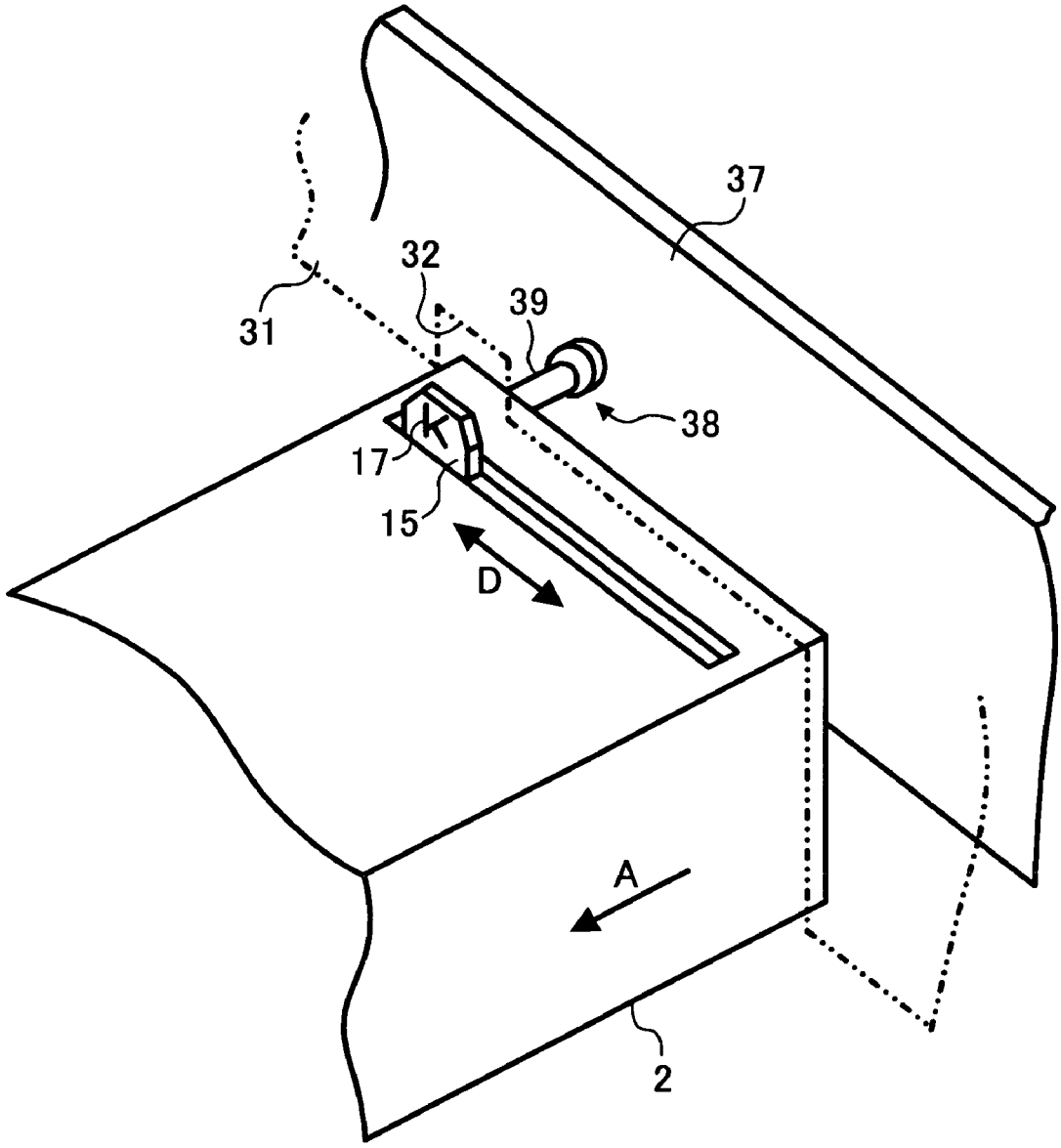
FIG. 7 is a diagram illustrating the photoconductor unit in the installed state, as a device unit according to the second embodiment of the present invention.
Figure 8A:
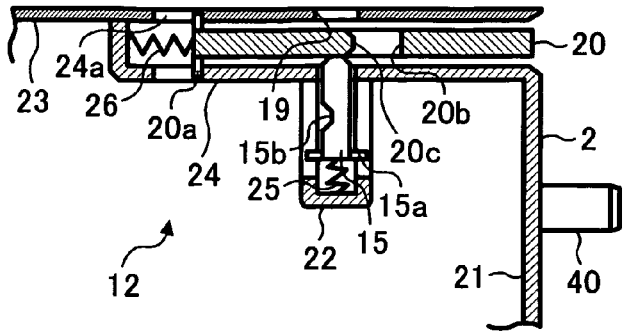
FIG. 8A is a cross section of the photoconductor unit of the second embodiment in the initial state before installment.

Now, the photoconductor unit 2 as a device unit according to the second embodiment of the present invention is described. FIG. 7 illustrates the photoconductor unit 2 according to the second embodiment in the installed state. FIG. 8A is a cross section of the photoconductor unit 2 in the initial state before installment, FIG. 8B is a cross section of the photoconductor unit 2 in the installed state, and the FIG. 8C is a cross section of the photoconductor unit in the midst of being uninstalled.

While in the previous embodiment, the striker 39 as the activation device 16 is provided to the rear side plate 28 fixed to the main body 1A, and the striker 39 is relatively moved toward the photoconductor unit 2 to activate the predetermined corresponding recognition device 12 by the movement of the photoconductor unit 2 in the installing direction, in this embodiment, the striker 39 as an activation device 38 is provided in a predetermined place of a plate 37 provided to the main body 1A and configured to open and close, and as the plate 37 is closed, the striker 39 activates the predetermined corresponding recognition device 12 of the photoconductor unit 2. Accordingly, after installing all of the plurality photoconductor units 2 to respective installation parts, by moving the plate 37 to the closed position, the recognition devices 12 of the photoconductor units 2 are respectively activated at once by the strikers 39 provided in respective predetermined places of the plate 37 to correspond to the installation parts, and only the recognition plates 15 of the recognition devices 12 corresponding to respective installation parts are protruded from the photoconductor units 2.

In each photoconductor unit 2, the recognition devices 12 are arranged in parallel with each other in predetermined places at the side of the rear side of the photoconductor unit 2 in the installing direction as illustrated in FIG. 7. One end of the lateral accommodation part 24 of each recognition device 12 is opened at a part of the vertical side wall of the lower cartridge frame 21 located at the tip end side of the photoconductor unit 2 in the installing direction of the photoconductor unit 2, and the other end is closed, as illustrated in FIG. 8A. The stopper 20 accommodated in the lateral accommodation part 24 is pressed toward the opening by the pressing spring 26 arranged at the base end thereof.

Figure 8B:
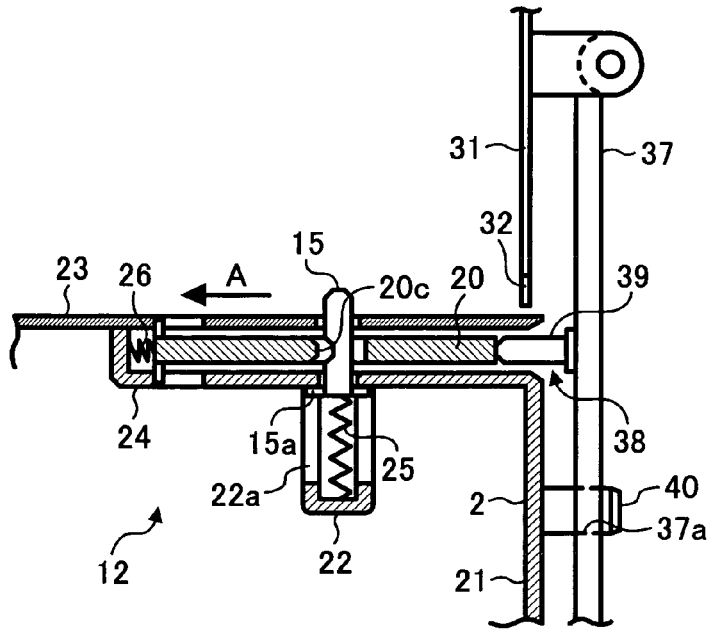
FIG. 8B is a cross section of the photoconductor unit in the installed state.
Figure 8C:
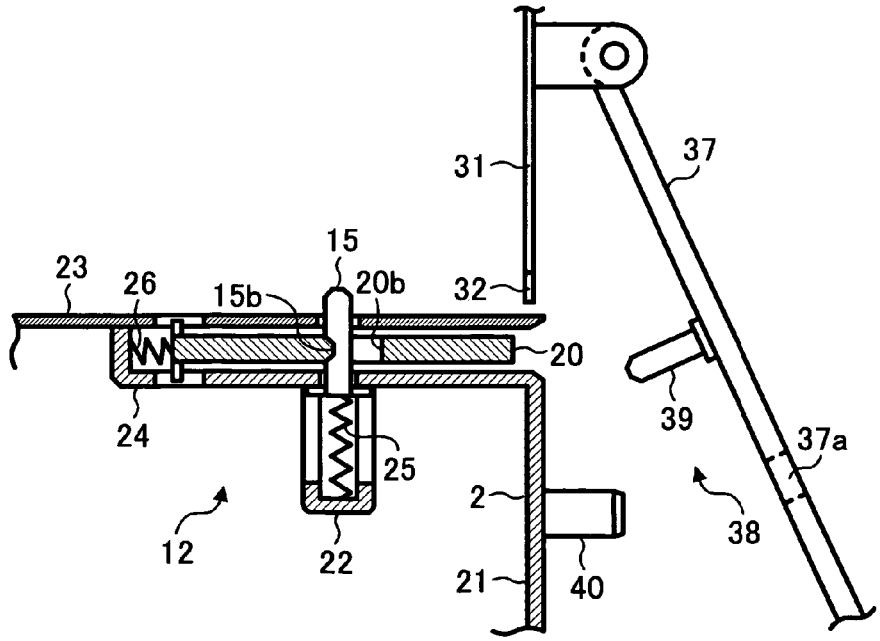
FIG. 8C is a cross section of the photoconductor unit in the midst of being uninstalled.

The activation device 38 for each installation part includes, as illustrated in FIG. 7, FIG. 8B, and FIG. 8C, the striker 39 provided in a protruding manner in a predetermined place of the plate 37.

The plate 37 is supported, as illustrated in FIG. 8B and FIG. 8C, by the front side plate 31 of the main body 1A at the upper end edge part thereof by means of a horizontal axis so as to open and close. When the plate 37 is in the opened position, all of the installation parts of the main body 1A are opened so that the photoconductor units 2 can be freely installed and uninstalled, and when the plate 37 is in the closed position, the plate 37 forms the vertical wall opposing the rear end surfaces of the installed photoconductor units 2, and at the same time, positioning pins 40 of the photoconductor units 2 are engaged with positioning through-holes 37*a* formed in respective predetermined places of the plate 37 to accurately position the installed photoconductor units 2 in respective installation parts.

The strikers 39 are provided in predetermined places of the plate 37 for respective installation parts to protrude in the installing direction of the photoconductor unit 2. That is, the striker 39 for each installation part is provided in a position opposing the opening formed in the vertical side wall of the lower cartridge frame 21 to communicate with the lateral accommodation part 24 accommodating the stopper 20 of the recognition device 12 so as to release the restriction relative to the stopper 20 of the recognition device 12 corresponding to the installation part among the plurality of recognition devices 12 provided to the photoconductor unit 2.

Accordingly, when the photoconductor unit 2 has been installed for the first time to an installation part and the plate 37 is moved to the closed position, as the plate 37 is moved to the closed position, the striker 39 is moved to contact and move the stopper 20 of the recognition device 12 corresponding to the installation part among the plurality of recognition devices 12 provided to the photoconductor unit 2, and thereby, the restriction by the stopper 20 to keep the recognition plate 15 in the initial position is released, so that the recognition plate 15 of the recognition device 12 corresponding to the installation part is protruded.

Thus, after installing the photoconductor unit 2 that has not been used before and is in the initial state illustrated in FIG. 8A to one of four installation parts provided to the main body 1A, when the plate 37 is closed as illustrated in FIG. 8B, the stopper 20 of the recognition device 12 corresponding to the installation part is pressed by the striker 39 provided to the plate 37 and is moved from the position of restricting the recognition plate 15 in the initial position to the position of allowing the recognition plate 15 to be protruded. Thereby, the predetermined recognition plate 15 is protruded from the predetermined place of the long hole 19 provided in the upper cartridge frame 23.

Because the striker 39 is provided close to the positioning pin 40 of the photoconductor unit 2, as the positional accuracy of the positioning pin 40 is higher, the positional accuracy of the striker 39 is increased, so that the striker 39 reliably and stably contacts the tip end of the stopper 20 of the predetermined recognition device 12 of the photoconductor unit 2 and thereby the predetermined recognition device 12 can be reliably activated.

When the plate 37 is opened, as illustrated in FIG. 8C, the stopper 20 is released from being depressed by the striker 39 and moves toward the opening of the lateral accommodation part 24. Thereby, the protrusion 20*c* of the stopper 20 engages with the concave part 15*b* of the recognition plate 15, so that the recognition plate 15 is prevented from being moved in the up-and-down direction. As the result, a protrusion shape that did not exist initially in the photoconductor unit 2 is formed in the photoconductor unit 2.

Figure 9:
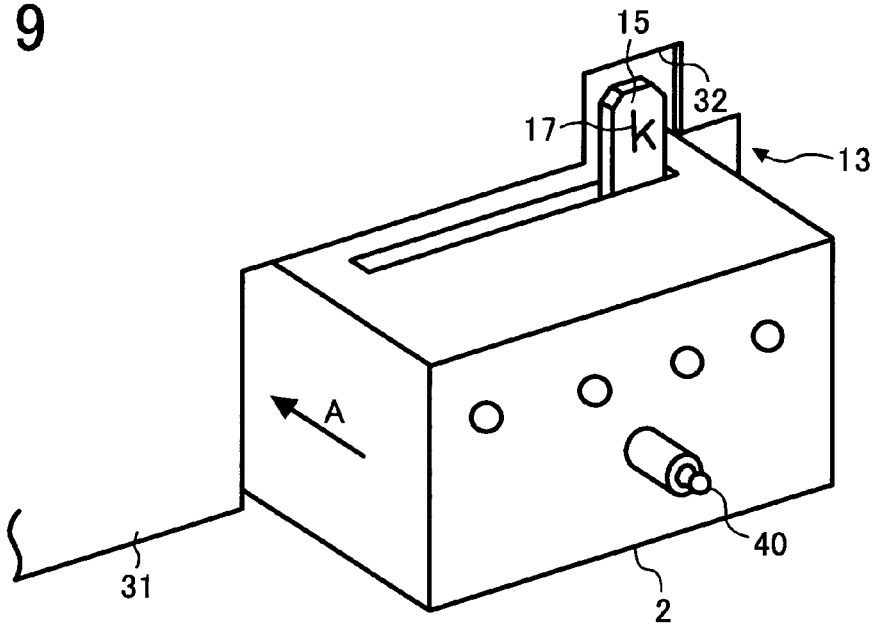
FIG. 9 is a perspective view of the photoconductor unit of the second embodiment in the midst of being installed to a correct installation part again.
Figure 10:
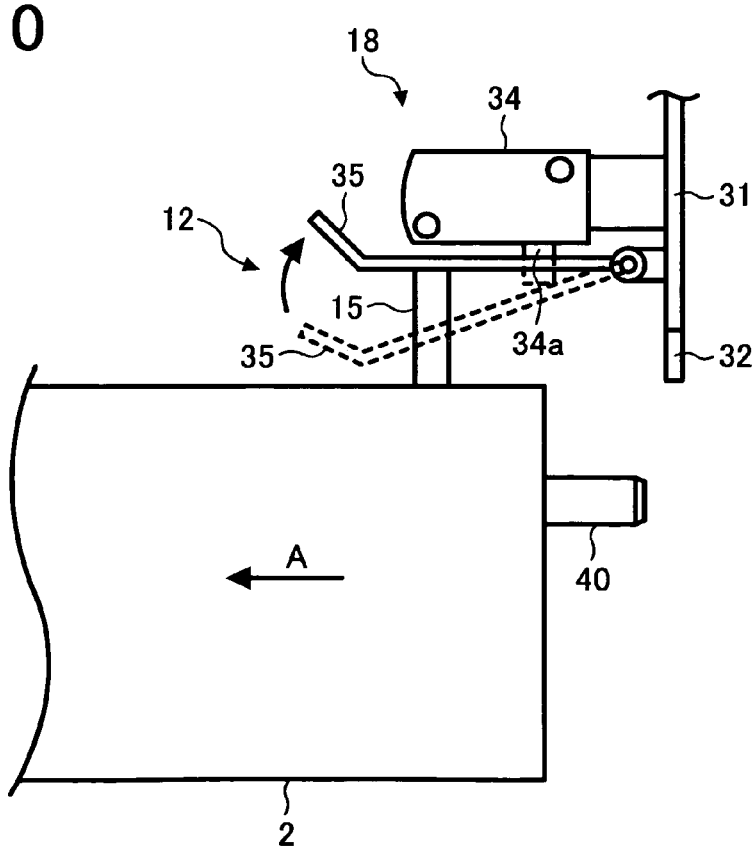
FIG. 10 is a diagram illustrating a detection device to detect the photoconductor unit of the second embodiment correctly installed again.

Further, as illustrated in FIG. 9, the prevention device 13 similarly configured and operated as in the first embodiment is provided. Furthermore, as illustrated in FIG. 10, the detection device 18 is provided in a predetermined place of the side wall surface of the front side plate 31 opposing the protruded recognition plate 15 of the photoconductor unit 2 to detect the protruded recognition plate 15. The configuration and the operation of the detection device 18 are substantially the same as those described with respect to the first embodiment.

According to the second embodiment, the effects obtained in the first embodiment are obtained. Further, the effects are obtained without changing the ordinary procedure of replacing the used photoconductor unit 2 with the new one and closing the plate 37, which is convenient.

Furthermore, according to the second embodiment, in addition to the effects obtained in the first embodiment, the effect is obtained that the possibility that two photoconductor units 2 are prescribed to be installed to the same installation part is decreased. That is, in the first embodiment, after installing the photoconductor unit 2 that has not been used before to an installation part for magenta, for example, initially, if the photoconductor unit 2 has been uninstalled for some reason and thereafter, if another photoconductor unit 2 that has not been used before is installed to the same installation part for magenta, two photoconductor unit 2 prescribed to be installed to the same installation part for magenta are generated. On the other hand, in this embodiment, unless the plate 37 is closed, each recognition device 12 of the installed photoconductor unit 2 is not activated to protrude the recognition plate 15. That is, the photoconductor unit 2 installed to the installation part for magenta, for example, for the first time is not prescribed to be installed to the installation part for magenta and is kept in the unused state unless the plate 37 is closed. Thus, the above-described possibility that two photoconductor units 2 are prescribed to be installed to the same installation part is avoided unless the plate 37 is closed.

In particular, four photoconductor units 2 can be prescribed to be installed to respective installation parts at one time by closing the plate 37 after confirming that the photoconductor unit 2 has been installed to each of four installation parts. Thereby, the possibility that various erroneous recognitions are caused can be decreased, and the possibility that a plurality of photoconductor units 2 is prescribed to be installed to the same installation part can be avoided.

Now, the third embodiment of the present invention is described. An image forming apparatus serving as an apparatus according to the third embodiment of the present invention is, for example, a color copier or a color printer using an ink printing system. Although not shown in figure, in the image forming apparatus, a plurality of installation parts, to each of which an ink printing unit as a device unit of the present invention is installed, are arranged in parallel with each other along a sheet conveyance path formed within the main body of the apparatus. The installation parts function as image formation parts for forming ink images of respective colors by installing the ink printing units, respectively. Each ink printing unit includes at least an ink printing head configured to eject ink of a certain color to a sheet being conveyed through the sheet conveyance path. Further, the ink printing unit is configured to be detachably installed to and uninstalled from any of the installation parts. The number of the ink printing units (i.e., the number of colors of inks) is not limited to four as in the first and the second embodiments. Further, the order of arrangement of the ink printing units may be in any order and is not limited to the order of magenta, cyan, yellow, and black as in the first and the second embodiments.

Each ink printing unit is configured such that at least the ink printing head and related elements are integrated with ach other and accommodated in a housing. The shapes and the configurations of the ink printing units are substantially the same without depending on respective installation parts, and each ink printing unit is configured to be easily installed to and uninstalled from any of the installation parts. When the ink printing unit has been installed to an installation part and is used, the ink of a color corresponding to the installation part is supplied to the ink printing unit from an ink tank containing the ink of the color, which is fixedly provided to the main body. Each ink printing unit may include a line-type ink printing head having a sufficient number of nozzles to meet the image width corresponding to the width of a maximum-size sheet conveyed through the sheet conveyance path and fixedly arranged in a predetermined place of the main body or a movable-type ink printing head having nozzles smaller in number than the sheet width and configured to be moved in a predetermined direction. The ink printing unit is configured as a cartridge unit integrally including at least one or more of a carriage mechanism configured to drive the ink printing head to move in the direction perpendicular to the direction in which the sheet is conveyed (only when the ink printing head is a movable type), a capping mechanism configured to prevent lowering of the ink ejection performance by closing the ink ejection opening of each nozzle when the apparatus is not in operation, for example, as in the waiting state, a cleaning device configured to clean the ink ejection opening to maintain the ink ejection performance at a predetermined level, and an ink tank configured to temporarily store the ink supplied from the main body to stably supply the ink to the ink printing head. That is, each of the ink printing units is configured as a so-called universal cartridge having the same configuration and the same function, and is configured such that the function thereof is controlled by a controller provided at the side of the main body according to the characteristic of the ink supplied to the installation part to which the ink printing head unit has been installed.

The image forming apparatus forms a full color image on a sheet being conveyed through the sheet conveyance path by superimposing ink images of respective colors formed by the ink printing units installed to the installation parts for respective colors.

The restriction device described with respect to the first and second embodiments is provided to the image forming apparatus. The restriction device physically prevents the ink printing unit initially installed to any of the plurality of installation parts from being installed to another installation part of the plurality of installation parts as in the first and the second embodiments. The restriction device includes a recognition device provided to the ink printing unit and a prevention device provided to the main body. The configurations of the recognition device and the prevention device and related configurations thereof (such as an activation device, an indication device, a detection device, etc.) are substantially the same as those of the previous embodiments, so that the description thereof is omitted.

Thus, according to the third embodiment, the effects obtained in the first embodiment and/or the second embodiment can be obtained.

The present invention can be applied to an image forming apparatus using both of electrophotograpy and the ink printing method. For example, the above-described restriction device may be provided in an image forming apparatus in which a plurality of image formation units, each using electrophotography, such as the above-described photoconductor unit, and a plurality of image formation units, each using the ink printing method, such as the above-described ink printing unit, are provided in a plurality of installation parts. When an image forming apparatus includes an image formation unit forming images in a single color and a plurality of image formation units forming images of a plurality of colors, the restriction device of the present invention may be provided for the plurality of image formation units. Thus, the present invention can be applied to an image forming apparatus using either of or both of electrophotography and the ink printing method.

In the above-described embodiments, the case has been described that the present invention is applied to a device unit that is installable to any of a plurality of installation parts of an apparatus to be used and that is prescribed to be exclusively installable to-an installation part of the plurality of installation parts when the device unit has been installed to the installation part for the first time. That is, the device unit is prescribed as a unit dedicated for installation to a specific installation part among the plurality installation parts, to which toner or ink of a specific color is supplied.

However, the present invention can be applied to any device unit that is installable to any of a plurality of installation parts of an apparatus to be used and that is required, after once having been installed to an installation part of the plurality of installation parts, to be prevented from being installed to another installation part. That is, the present invention can be applied to a device unit that is configured to operate and function in the same manner relative to any of a plurality of installation parts of an apparatus but that is preferably kept being used at the same installation part. For example, the present invention can be applied to a device unit that is preferably continuously used at one installation part of an apparatus until the life ends so that the operating record and history of the device unit is easily and reliably obtained at the side of the main body.

Further, when an apparatus in which a device unit is installed to each of a plurality of installation parts-of the apparatus is an image forming apparatus and the device unit is a photoconductor unit and when, although the colors of toners supplied to respective installation parts are the same, the printing characteristics of the toners are different from each other such that when formed images are fixed by a fixing device of the apparatus, the images are fixed by the fixing device to be different from each other in gloss, it is necessary to avoid each photoconductor unit from being installed to an installation part that is different from the installation part to which the photoconductor unit has been initially installed. Therefore, the present invention can be applied to an image forming apparatus in which not only the colors but also the printing characteristics of toners or inks used for respective installation parts are different from each other.

Furthermore, in the above-described embodiments, in each recognition device 12 of the photoconductor unit 2, the compressed springs 26 and 22 are used for pressing the stopper 20 and the recognition plate 15 in predetermined directions. However, a spring may be arranged to pull the stopper 20 or the recognition plate 15, and the arrangement and configuration of each related member may be appropriately changed.

Furthermore, in the above-described embodiments, the recognition devices 12 of the photoconductor unit are arranged at the side opposing the striker 29 or 39. However, the recognition devices 12 may be arranged at a part of the photoconductor unit 2 separated from the side opposing the striker 29 or 39 or at the side of the photoconductor unit 2 opposite the side opposing the striker 29 or 39. For example, without extending the protruding length of the striker 29 or 39 from the surface where the striker 29 or 39 is provided, a long rod member or a wire member having elasticity may be provided at the side of the photoconductor unit 2 as an intermediary member transmitting relative movement of the striker 29 or 39 relative to the photoconductor unit 2 to the stopper 20.

Numerous additional modifications and variations of the present invention are possible in light of the above-teachings. It is therefore to be understood that within the scope of the claims, the present invention can be practiced otherwise than as specifically described herein.

What is claimed is:

1. An apparatus, comprising:

a plurality of installation parts, to each of which a device unit is detachably installed to be used;

an activation device including a striking member; and a restriction device configured to restrict the device unit having been installed in an unused state to and uninstalled from any one of the plurality of installation parts from being installed to any other installation part of the plurality of installation parts, wherein the restriction device includes, a recognition device configured to form, when the device unit has been initially installed to an installation part of the plurality of installation parts, a protrusion shape peculiar to the installation part in the device unit, and a prevention device configured to prevent the device unit from being installed to another installation part of the plurality of installation parts by contacting the protrusion shape formed in the device unit when the device unit is going to be installed to the another installation part.

2. The apparatus according to claim 1, wherein the activation device is configured to activate the recognition device to form the protrusion shape in the device unit when the device unit is initially installed.

3. The apparatus according to claim 2, wherein the activation device is provided to a rear side plate of the apparatus.

4. The apparatus according to claim 2, wherein the apparatus includes a plate configured to be closed after installing the device unit, and the activation device is provided to the plate.

5. The apparatus according to claim 1, wherein the recognition device includes a plurality of recognition plates corresponding to the plurality of installation parts and respectively configured to be protruded from different places of the device unit in a direction perpendicular to a direction of installing the device unit, and wherein when the device unit has been initially installed to the installation part, a corresponding recognition plate of the plurality of recognition plates is selectively protruded from a corresponding place of the different places of the device unit and thereby the protrusion shape peculiar to the installation part is formed in the device unit.

6. The apparatus according to claim 5, wherein each recognition plate of the recognition device includes an indication device indicating a corresponding installation part.

7. The apparatus according to claim 1, wherein the apparatus is an image forming apparatus.

8. The apparatus according to claim 1, wherein the apparatus is an image forming apparatus and the device unit is a development device of the image forming apparatus.

9. The apparatus according to claim 8, wherein the development device is a cartridge unit integrally including at least one or more of an image bearing member, a charging device, a transfer device, and a cleaning device.

10. The apparatus according to claim 1, wherein the apparatus is an image forming apparatus and the device unit is an ink printing head unit of the image forming apparatus.

11. A device unit for use in an apparatus having a plurality of installation parts, to each of which the device unit is detachably installed to be used, the device unit comprising:

a housing;

a recognition device including, a plurality of recognition plates corresponding to the plurality of installation parts of the apparatus and respectively configured to be protruded from different places of the housing in a direction perpendicular to a direction of installing the device unit, wherein when the device unit has been initially installed to an installation part of the plurality of installation parts of the apparatus, a corresponding recognition plate of the plurality of recognition plates is selectively protruded from a corresponding place of the different places of the housing and thereby a protrusion shape peculiar to the installation part is formed in the device unit; and a mechanism configured to drive the recognition device when the device unit is initially installed and a striking member to strike the mechanism.

12. The device unit according to claim 11, wherein each recognition plate of the recognition device includes an indication device indicating a corresponding installation part.

13. The device unit according to claim 11, wherein the apparatus is an image forming apparatus, and the device unit is a development device of the image forming apparatus.

14. The device unit according to claim 13, wherein the development device is a cartridge unit integrally including at least one or more of an image bearing member, a charging device, a transfer device, and a cleaning device.

15. The device unit according to claim 11, wherein the apparatus is an image forming apparatus, and the device unit is an ink printing head unit of the image forming apparatus.

* * * * *